US005807071A

United States Patent [19]

Brasz et al.

[11] Patent Number: 5,807,071

[45] Date of Patent: Sep. 15, 1998

[54] VARIABLE PIPE DIFFUSER FOR CENTRIFUGAL COMPRESSOR

[76] Inventors: Joost J. Brasz, 1 Landgrove Dr., Fayetteville, N.Y. 13066; John W. Salvage, 6008 Singletree La., Jamesville, N.Y. 13078

[21] Appl. No.: 658,801

[22] Filed: Jun. 7, 1996

[51] Int. Cl.[6] ..... F04D 29/46

[52] U.S. Cl. ..... 415/150; 415/148

[58] Field of Search ..... 415/146, 150, 415/157, 158, 165, 166

[56] References Cited

U.S. PATENT DOCUMENTS

| | | | |
|---|---|---|---|
| Re. 6,285 | 2/1875 | Ross | 415/166 |
| 3,784,318 | 1/1974 | Davis | 415/158 |
| 5,372,485 | 12/1994 | Sumser et al. | 415/166 |

FOREIGN PATENT DOCUMENTS

| | | | |
|---|---|---|---|
| 0091931 | 8/1896 | Germany | 415/166 |
| 0538960 | 7/1930 | Germany | 415/158 |
| 0149298 | 6/1993 | Japan | 415/166 |

*Primary Examiner*—Christopher Verdier

[57] ABSTRACT

A variable pipe diffuser for use in a centrifugal compressor. The variable pipe diffuser includes an outer ring and an inner ring which is rotatable circumferentially within the outer ring between a first, open position and a second, closed position. In an open position, complementary air channel sections of the inner and outer rings are aligned with one another to allow a maximum flow of refrigerant through the diffuser. In a closed position, the flow channels of the ring sections are misaligned and the flow of refrigerant through the diffuser is restricted. By adjusting the diffuser rings toward a closed position, surge conditions can be avoided even in the case where a high compressor pressure ratio is required.

7 Claims, 5 Drawing Sheets

VARIABLE PIPE DIFFUSER FOR CENTRIFUGAL COMPRESSOR

BACKGROUND OF THE INVENTION

1. Field of the Invention

The present invention relates to centrifugal compressors in general and in particular to a diffuser structure for centrifugal compressor.

2. Background of the Prior Art

One of the major problems arising in the use of centrifugal vapor compressors for applications where the compressor load varies over a wide range is flow stabilization through the compressor. The compressor inlet, impeller and diffuser passages must be sized to provide for the maximum volumetric flow rate desired. When there is a low volumetric flow rate through such a compressor, the flow becomes unstable. As the volumetric flow rate is decreased from a stable range, a range of slightly unstable flow is entered. In this range, there appears to be a partial reversal of flow in the diffuser passage, creating noises and lowering the compressor efficiency. Below this range, the compressor enters what is known as surge, wherein there are periodic complete flow reversals in the diffuser passage, destroying the efficiency of the machine and endangering the integrity of the machine elements. Since a wide range of volumetric flow rates is desirable in many compressor applications, numerous modifications have been suggested to improve flow stability at low volumetric flow rates.

Many schemes have been devised to maintain high machine efficiencies over a wide operation range. In U.S. Pat. No. 4,070,123, the entire impeller wheel configuration is varied in response to load changes in an effort to match the machine performance with the changing load demands. Adjustable diffuser flow restrictors are also described in U.S. Pat. No. 3,362,625 which serve to regulate the flow within the diffuser in an effort to improve stability at low volumetric flow rates.

A common technique for maintaining high operating efficiency over a wide flow range in a centrifugal machine is through use of the variable width diffuser in conjunction with fixed diffuser guide vanes.

U.S. Pat. Nos. 2,996,996 and 4,378,194, issued to a common assignee, describe variable width vaned diffusers wherein the diffuser vanes are securely affixed, as by bolting to one of the diffuser walls. The vanes are adapted to pass through openings formed in the other wall thus permitting the geometry of the diffuser to be changed in response to changing load conditions.

Fixedly mounting the diffuser blades to one of the diffuser walls presents a number of problems particularly in regard to the manufacture, maintenance and operation of the machine. Little space is afforded for securing the vanes in the assembly. Any misalignment of the vanes will cause the vane to bind or rub against the opposite wall as it is repositioned. Similarly, if one or more vanes in the series has to be replaced in the assembly, the entire machine generally has to be taken apart in order to effect the replacement.

SUMMARY OF THE INVENTION

According to its major aspects and broadly stated, the present invention relates to a variable geometry pipe diffuser for a centrifugal compressor.

A variable geometry pipe diffuser (which may also be termed a split-ring pipe diffuser) according to the present invention includes a first, inner ring and a second outer ring.

The inner and outer rings have complementary inlet flow channel sections formed therein. That is, each inlet flow channel section of the inner ring has a complementary inlet flow channel section formed in the outer ring. The inner ring and outer ring are rotatable respective one another. Preferably, the inner ring rotates circumferentially within the outer ring. However the outer ring can instead be made rotatable circumferentially about a stationary inner ring.

When one ring is rotated respective the other, the alignment between each pair of complementary air channel sections of the rings change. The rings are adjustable between a first, open position wherein complementary channel sections of the rings are aligned to allow a maximum amount of fluid to pass through the inner and outer rings, and a second, closed position wherein fluid flow through the channels is restricted and decreased volume of fluid passes through complementary inlet flow channel sections of the inner and outer rings. The rings may also be made adjustable to any number of intermediate positions between the open and closed positions.

In the second, closed position, at least about 10% the volume of flow as in the fully open position should flow through the diffuser so as to prevent excessive thermodynamic heating of component parts of the machine. To the end that thermodynamic heating is prevented, the amount of relative rotation between the two ring sections should be limited to an amount of rotation necessary to effect a second, closed position. In other words, the rings should not be adjustable to completely close off a flow of fluid therebetween. The degree of allowable rotation between the two rings is determined by the desired flow between the rings in a fully closed position, and the number and volume of inlet air channels in the ring sections. Complete closure of an inlet flow channel can also be prevented by providing an inner ring having non-channel portions thereof sized to a width less than the minimum width of an outer ring flow channel.

By adjusting the variable pipe diffuser toward a closed position, the surge point in a performance plot for a compressor having the present diffuser is adjusted toward a lower flow rate. The pressure generated by a compressor at this lower flow rate is approximately the same as that of a compressor having a diffuser in the fully open position. Accordingly, the present invention is especially useful for adjusting compressor characteristics so that a compressor can meet a low flow rate, high pressure ratio condition. Such an operating condition is required, for example, where there is a large difference between indoor and outdoor ambient temperature, but low system loading.

The efficiency of a compressor at a given operating condition can often be optimized by combining an adjustment of a variable diffuser as described herein with an adjustment of a compressor's inlet guide vanes.

BRIEF DESCRIPTION OF THE DRAWINGS

In the drawings, wherein like numerals are used to indicate the same elements throughout the views.

Figure 1:
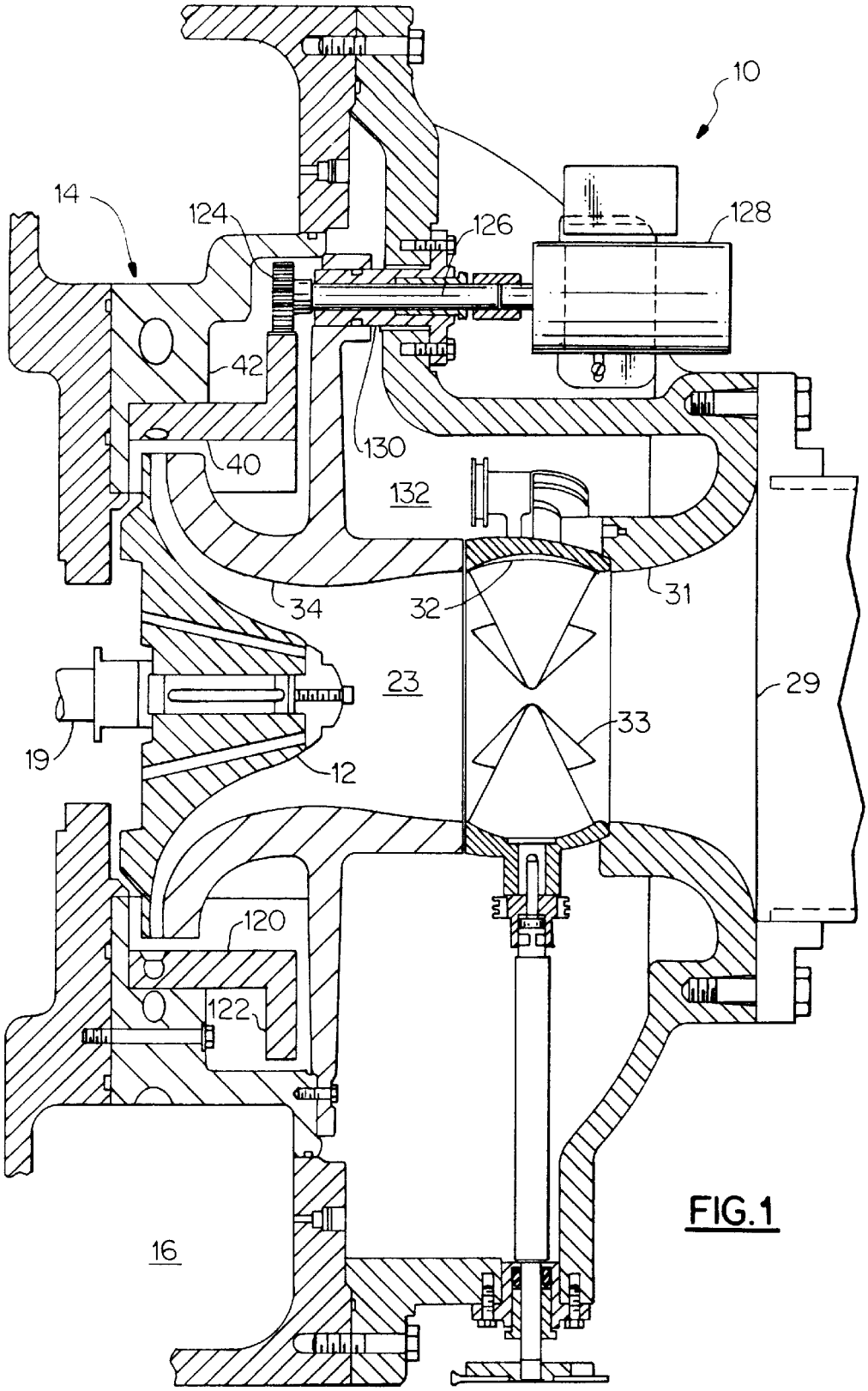
FIG. 1 is a cross-sectional side view of compressor according to the invention having a variable pipe diffuser.

DETAILED DESCRIPTION OF THE PREFERRED EMBODIMENTS:

Referring now to FIG. 1, the invention is shown as installed in a centrigual compressor 10 having an impeller 12 for accelerating refrigerant vapor to a high velocity, a diffuser 14 for decelerating the refrigerant to a low velocity while converting kinetic energy to pressure energy, and a discharge plenum in the form of a collector 16 to collect the discharge vapor for subsequent flow to a condenser. Power to the impeller 12 is provided by an electric motor (not shown) which is hermetically sealed in the other end of the compressor and which operates to rotate a high speed shaft 19.

Referring now to the manner in which the refrigerant flow occurs in the compressor 10, the refrigerant enters the inlet opening 29 of the suction housing 31, passes through the blade ring assembly 32 and the guide vanes 33, and then enters the compression suction area 23 which leads to the compression area defined on its inner side by the impeller 12 and on its outer side by the shroud 34. After compression, the refrigerant then flows into the diffuser 14, the collector 16 and the discharge line (not shown).

Figure 3:
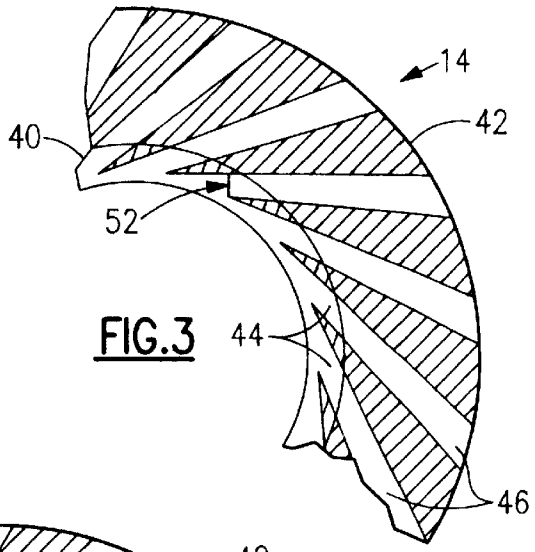
FIGS. 3 and 4 are cross-sectional front views of a variable pipe diffuser in accordance with the invention in a first, open, and a second, closed position, respectively.
Figure 2:
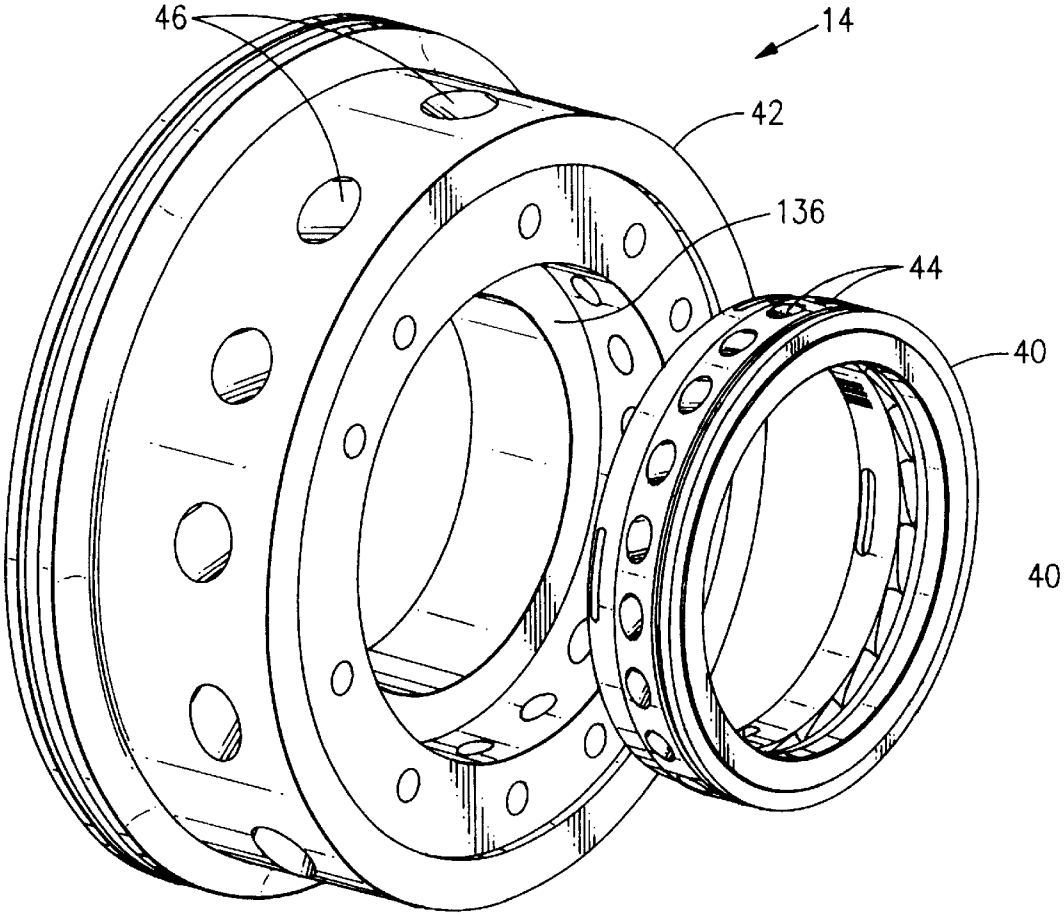
FIG. 2 is a perspective view of a variable pipe diffuser according to the invention.

As seen in FIGS. 1–3, a variable geometry pipe diffuser 14 according to the present invention includes a first, inner ring 40 and a second outer ring 42. The inner and outer rings have complementary flow channel sections 44 and 46 formed therein. That is, each flow channel section 44 of the inner ring 40 has a complementary channel section 46 formed in outer ring 42. Inner ring 40 and outer ring 42 are rotatable respective one another. Preferably, inner ring 40 rotates circumferentially within outer ring 42. However, outer ring 42 can instead be made rotatable circumferentially about a stationary inner ring 40.

Figure 4:
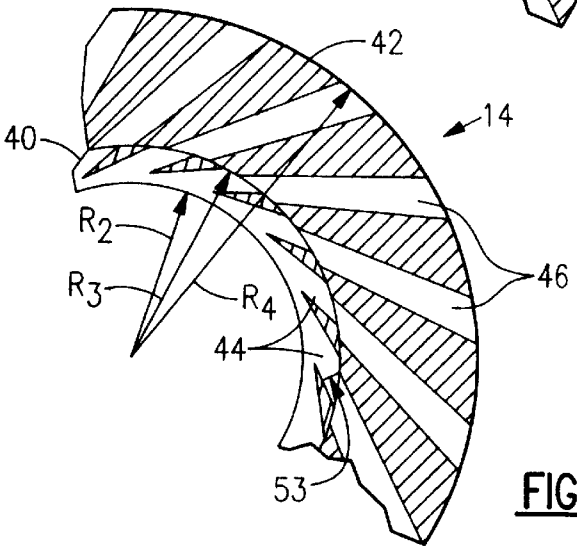

When one ring is rotated respective the other, the alignment between each pair of complementary inlet flow channels of the inner and outer rings changes as seen with reference to FIGS. 3 and 4. Rings 40 and 42 are adjustable between a first open position, as illustrated in FIG. 3, wherein complementary channel sections are aligned and a maximum amount of fluid passes through inner and outer rings 40 and 42, and a second, closed position, as illustrated in FIG. 4, wherein complementary channels are misaligned and flow through the channel sections 44 and 46 is restricted.

The flow of fluid through diffuser 14 in a second closed position in relation to the open position flow rate is determined by the ratio of the minimum cross-sectional area of a flow channel of a diffuser in a closed position to the minimum cross-sectional area of a flow channel (defined by complementary channel sections 44 and 46) in an open position. This minimum flow channel area, known as the "throat area" will generally be determined by the smallest diameter of the flow passage 52 of the inner ring channel 44 when diffuser 14 is in an open position, and will be controlled by the width 53 at the interface between the inner and outer rings 40 and 42 when diffuser 14 is in a second closed position. For example, if a diffuser channel has a minimum area (throat area) of ⅛ in. in a second closed position, and a minimum area (throat area) of ¼ in. in an open position then the volumetric flow rate of fluid through a diffuser in a closed position will be about 50% of the flow rate as in a fully open position. The flow rate of fluid through compressor 10 when diffuser 14 is in a second, closed position, will generally be between about 10% and 100% of the flow rate of fluid through compressor 10 when diffuser is in a first open position.

In a second closed position (FIG. 4), at least about 10% the volume of flow as in the fully open position should flow through diffuser 14 so as to prevent excessive thermodynamic heating of component parts of compressor 10. To the end that a condition of excessive thermodynamic heating is avoided, the amount of relative rotation between the two ring sections should be limited to an amount of rotation necessary to effect a second closed position. In other words, the rings should not be adjustable to completely close off a flow of fluid therebetween. The degree of allowable rotation between the two rings is determined by the desired flow between the rings in a fully closed position, and the number and volume of inlet flow channel sections 44, 46 in the ring sections 40 and 42 in relation to the volume of the ring sections 40 and 42. Complete closure of an inlet flow channel can also be prevented by providing an inner ring 40 having nonchannel portions thereof sized to a width less than the minimum width of an outer ring channel section 46.

Continuing with reference to FIG. 4, $R_2$ defines the radius of the impeller tip, $R_3$ defines the radius of inner ring 40, and $R_4$ defines the radius of outer ring. By making the thickness, defined by the Quantity $T=R_3-R_2$ of inner ring 40 no larger than is necessary to block a desired portion (e.g. 50% of flow) of flow through outer ring channels 46, the flow of fluid through diffuser 14 can be efficiently controlled. Rotation of the inner ring with respect to the outer ring will reduce the diffuser throat area before any diffusion has taken place, thus preventing flow acceleration after diffusion. Also, the smaller the inner ring thickness, T, the smaller the turning angles of the flow through the partially closed-off variable pipe diffuser. Both of the above-described effects tend to improve compressor efficiency under part-load operating conditions.

Figure 1A:
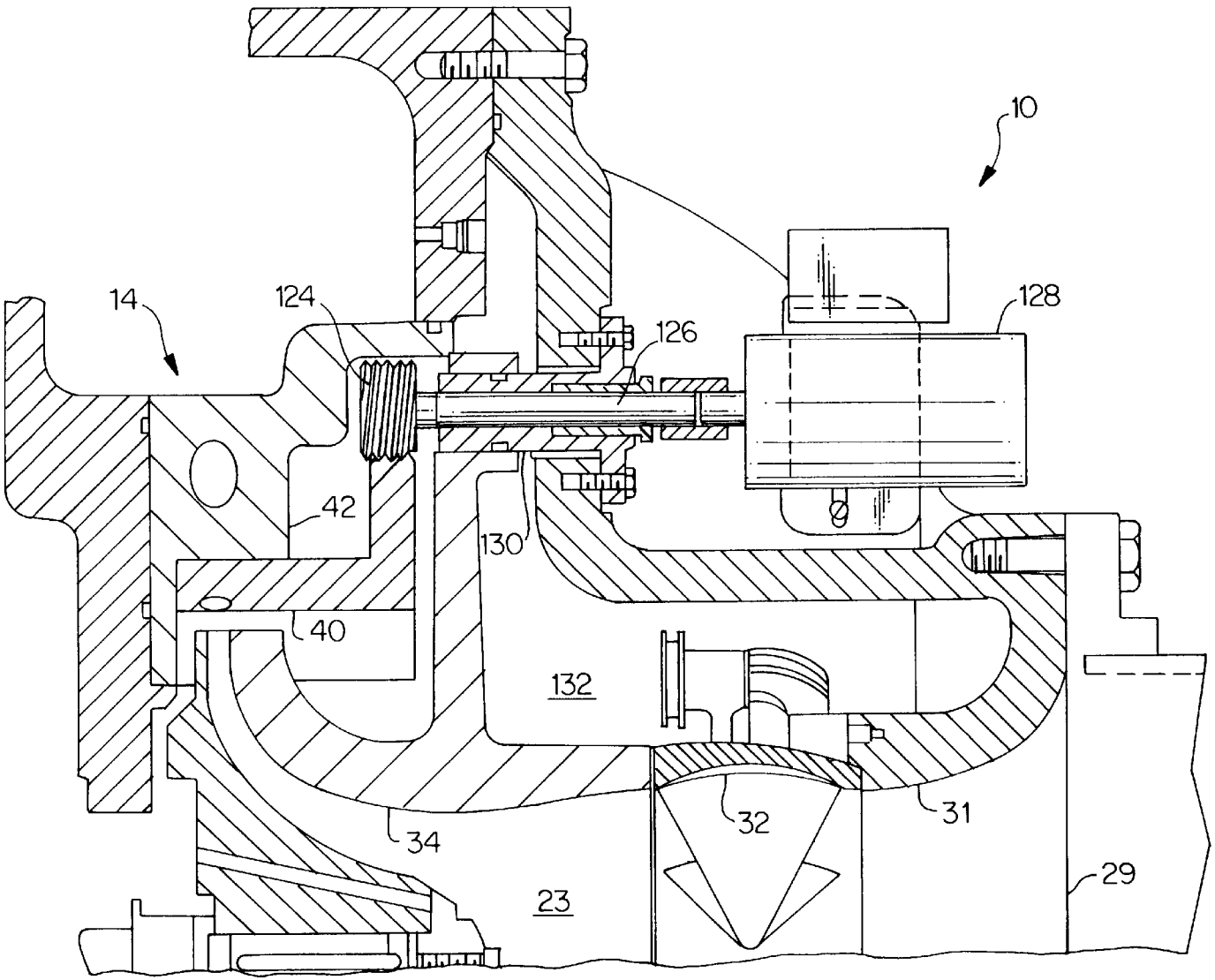
FIG. 1A is a sectional view of a variable pipe diffuser with axially offset portions as installed in accordance with the present invention.

A variable pipe diffuser in accordance with the invention can also be made by providing an inner ring 40 that is moveable axially in relation to an outer ring 42 as shown in FIG. 1A. Such an embodiment is normally not as preferred as the pair of circumferentially rotatable rings described because, in a pair of diffuser rings moveable axially in relation to one another, there are high turning losses resulting from the 9020 turns involved. The rings axially in relation to one another can be provided similar to those described in commonly assigned U.S. Pat. Nos. 4,527,949; 4,378,194; and 4,219,305, all incorporated by reference herewith.

Figure 5:
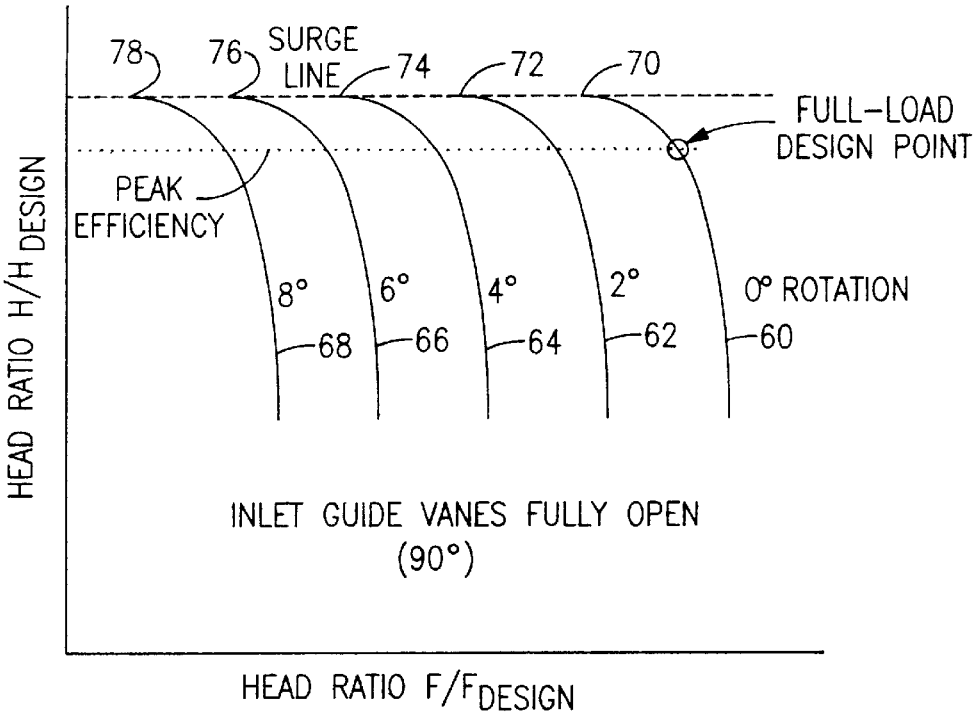
FIG. 5 is a performance diagram for a variable pipe diffuser according to the invention.

Operation and use of the present invention can be understood with reference to FIG. 5 showing a performance diagram for a compressor having a variable pipe diffuser according to the invention integrated therein. The performance diagram of FIG. 5, includes a plurality of performance plots 60,62,64,66,and 68, each corresponding to a discreet positioning between inner and outer ring sections 40 and 42. Each of the performance plots, 60, 62, 64, 66, and 68 is characterized by a surge point, 70, 72, 74, 76, and 78, respectively, which is the point of maximum available pressure. Operating a compressor at a flow rate at or below the surge point will likely result in a surge condition, as discussed in the Background of the Invention section herein.

For purposes of illustrating the invention, plot 60 may correspond, for example, to a first, open position, plot 62 may correspond to an intermediate 2 degree closed position, plot 64 may correspond to an intermediate 4 degree closed position, and plot 68 may correspond to a maximum 8 degree closed position.

It is seen that adjusting ring sections 40 and 42 toward a closed position has the effect of adjusting the surge point e.g. 70, 72 in a performance plot for a compressor toward a lower flow rate. Thus, a surge condition can be avoided during periods of low flow demand by adjusting diffuser rings 40 and 42 toward a closed position.

Figure 6:
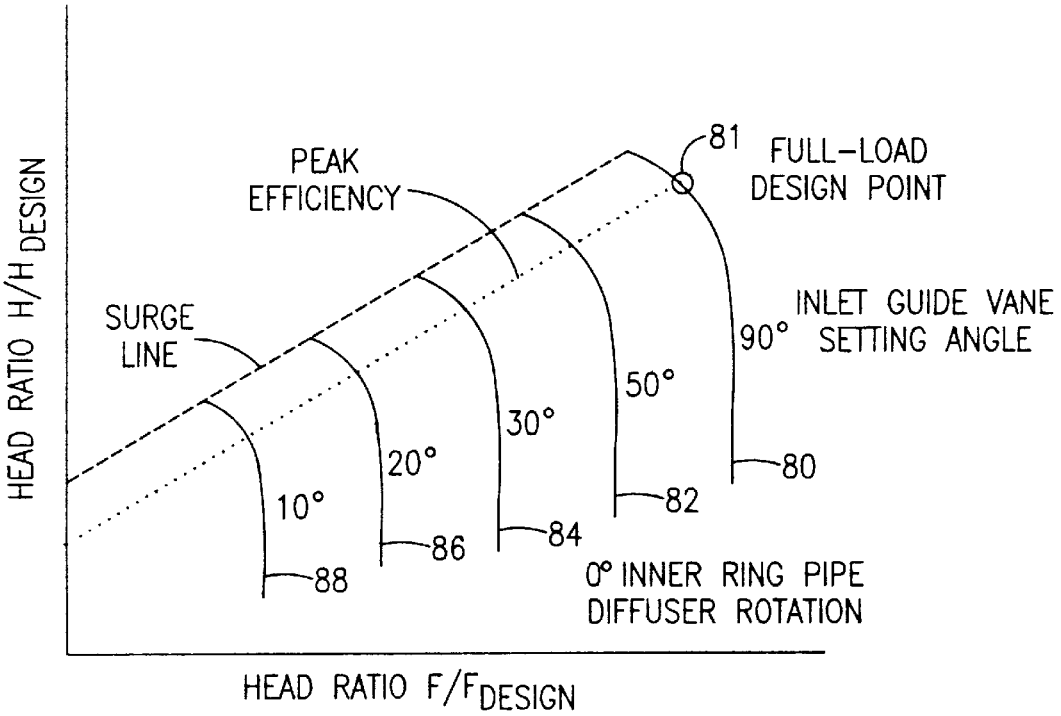
FIG. 6 is a performance diagram for a compressor having inlet guide vanes only.

It is helpful to understanding the invention to compare performance diagram of FIG. 5, for a compressor having a variable diffuser to the performance diagram 7 shown in FIG. 6 corresponding to a compressor having adjustable inlet guide vanes only. In FIG. 6, plots 80, 82, 84, and 86 and 88 correspond to discreet positioning of guide vanes 33 in increasingly closed positions. It is seen that closing guide vanes 33, like the closing of diffuser ring sections 40 and 42 has the effect of lowering the surge point flow rate. Thus, a surge condition can often be avoided by adjusting inlet guide vanes 33 toward a closed position.

However, it is seen from the performance diagram of FIG. 6 that adjusting guide vanes 33 toward a closed position has the further effect of lowering the head pressure available from compressor 10 at the surge point. Hence, a low flow rate operating condition requiring a relatively high pressure cannot be satisfied by adjusting guide vanes 33 alone.

By contrast, it is seen from the performance diagram of FIG. 5 that surge point pressure available from compressor 10 remains essentially stable when diffuser rings 40 and 42 are adjusted toward a closed position. Hence an operating condition requiring a low flow rate and high compressor pressure can be satisfied by adjusting diffuser rings 40 and 42 toward a closed position.

An operating condition requiring a low flow rate and a high pressure ratio relative to the full load operating pressure ratio (e.g. 90% of full load) is common in the case where there is a large difference (e.g. about 50° F. or more) between the ambient air temperature and indoor temperature, but occasional light loading in a building being cooled. In such a situation, a relatively high compressor pressure ratio (e.g. above about 2.5) is required by the refrigerant saturation pressures corresponding to the condenser, and evaporation temperatures, but only a reduced flow rate e.g. 25% of full load is needed to remove the heat generated within the building.

Figure 7:
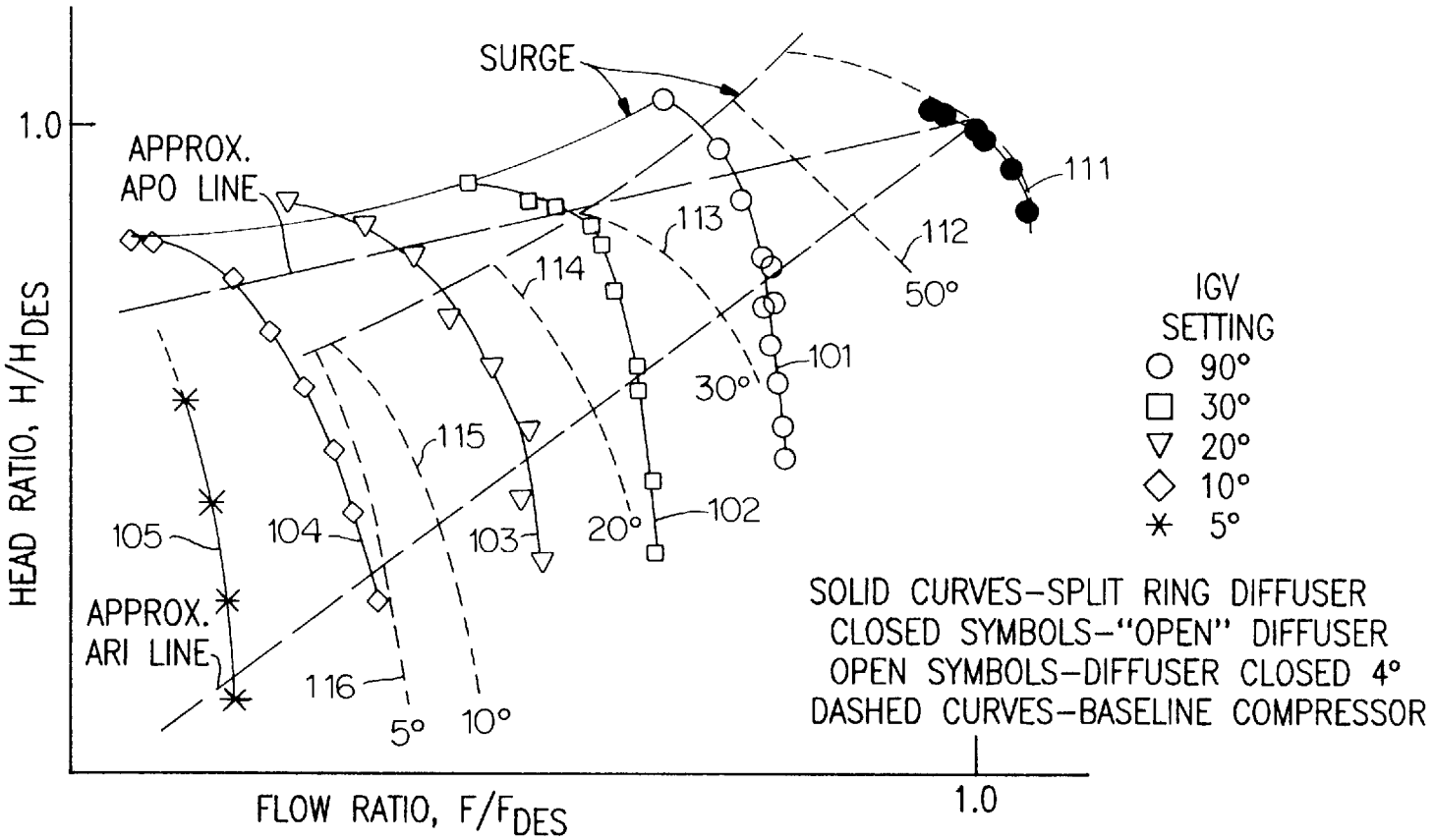
FIG. 7 is a performance diagram for a compressor according to the invention having a variable pipe diffuser and inlet guide vanes.

FIG. 7 shows a performance diagram for a compressor having both adjustable guide vanes and a variable pipe diffuser in accordance with the invention. It is seen that efficiency of a compressor can often be optimized by combining an adjustment of guide vanes 33 with an adjustment of diffuser rings 40 and 42. With reference to FIG. 7 dash curves 111, 112, 113, 114, 115, and 116 show performance plots for a compressor having a variable diffuser in a full open position for various positioning of inlet guide vanes 33, while solid curves 101, 102, 103, 104 and 105 show performance plots for a compressor having closed (here, there is about 40% of original flow rate in the closed position) diffuser rings at various guide vane positioning. As is well known to those skilled in the art, a compressor operates at optimum efficiency when operating at the "knee" (e.g. 81 at FIG. 6) of the performance plot characterizing performance of the compressor. With reference to diagram 7, the operating condition requiring, for example, a pressure of about 0.7 maximum, and a flow rate of about 0.3 maximum would be most efficiently satisfied by a compressor operating in accordance with plot 104, realized by adjusting diffuser rings 40 and 42 to a closed position and by adjusting guide vanes 33 to a 10 degree position.

A simple mechanical apparatus for rotating inner ring 40 circumferentially within outer ring 42 is described with reference again to FIG. 1. Cylinder 120, integral with inner ring 40, extends coextensively from inner ring 40 and has fixedly attached thereto flange 122 which extends radially outwardly from cylinder 120. In gearing relation with flange 122 is gear 124 which is driven via axle 126 by motor 128. Motor 128 is selected and controlled to effect movement of inner ring 40 in relation to outer ring 42 between fully open and a second closed position and any number of intermediate positions therebetween. Axle 126 is housed in a conventional containment housing 130 which hermetically seals axle 126 from compressor interior 132 and which prevents leakage of fluid out of compressor 10 through containment housing 130.

As best seen in FIG. 2, outer ring 42 may have seat 136 for assuring alignment between inner ring 40 and outer ring 42, and for preventing leakage of fluid through the interface between the two rings.

While the present invention has been explained with reference to a number of specific embodiments, it will be understood that the spirit and scope of the present invention should be determined with reference to the appended claims.

What is claimed is:

1. A centrifugal compressor having a casing and an impeller rotatably mounted therein for bringing a working fluid from an inlet to an entrance of an annular radially disposed diffuser, said diffuser including:

a first, inner ring, said inner ring having a plurality of first flow guide channel sections formed therein;

a second, outer ring, said outer ring having a plurality of second flow guide channels formed therein, each of said second flow guide channel sections having a complementary one of said first flow guide channel sections; and drive means for rotating said first and second rings in relation to one another between a first, open position wherein said complementary first and second flow channel sections are aligned to allow a maximum flow of said working fluid through each of said complementary channel sections, and a second, closed position, wherein said first and second complementary flow guide channels are misaligned to restrict but allow flow of fluid through each of said complementary channel sections.

2. The compressor of claim 1, wherein said drive means rotates said inner ring circumferentially within said outer ring.

3. The compressor of claim 1, wherein said drive means includes limiting means for limiting rotation between said inner and outer rings so that in said second closed position, a flow of air through said channels is not less than about 10% of a flow of air though said channels when said diffuser is in said first, open position.

4. The compressor of claim 1, wherein said drive means comprises:

a cylinder extending coextensively from said inner ring;

a flange extending radially outwardly from said cylinder;

gear means in gearing relation with said flange for rotating said flange; and motor means for driving said gear means.

5. The compressor of claim 1, wherein said inner ring includes a plurality of solid non-channel sections, each of said non-channel sections being sized to a width less than a minimum width of said outer ring flow guide channel sections.

6. The compressor of claim 1, wherein said inner ring is sized to a thickness no larger than is necessary to block a desired portion of flow through said outer ring flow guide sections.

7. A centrifugal compressor having a casing and an impeller rotatably mounted therein for bringing a working fluid from an inlet to an entrance of an annular radially disposed diffuser, said diffuser including:

a first, inner ring, said inner ring having a plurality of first flow guide channel sections formed therein;

a second, outer ring, said outer ring having a plurality of second flow guide channels formed therein, each one of said second flow guide channel sections having a complementary one of said first flow guide channel sections; and drive means for moving said inner and outer rings in axial relation to one another between a first, open position wherein said complementary first and second flow channel sections are aligned to allow a maximum flow of said working fluid through each of said complementary channel sections, and a second, closed position, wherein said first and second complementary flow guide channels are misaligned to restrict but allow flow of fluid through each of said complementary channel sections.

* * * * *

UNITED STATES PATENT AND TRADEMARK OFFICE

CERTIFICATE OF CORRECTION

PATENT NO. : 5,807,071
DATED : September 15, 1998
INVENTOR(S) : Joost J. Brasz, et al It is certified that error appears in the above-identified patent and that said Letters Patent is hereby corrected as shown below:

Column 6, line 66, please cancel claim 4.

Signed and Sealed this

Second Day of March, 1999

*Attest:*

*Attesting Officer*

Q. TODD DICKINSON

*Acting Commissioner of Patents and Trademarks*